US005563459A

United States Patent [19]

Kurosawa et al.

[11] Patent Number: 5,563,459

[45] Date of Patent: Oct. 8, 1996

[54] APPARATUS FOR CONTROLLING OPENING AND CLOSING TIMINGS OF A SWITCHING DEVICE IN AN ELECTRIC POWER SYSTEM

[75] Inventors: Yukio Kurosawa; Hiroshi Arita; Kunio Hirasawa, all of Hitachi; Tadashi Sato, Mito, all of Japan

[73] Assignee: Hitachi, Ltd., Tokyo, Japan

[21] Appl. No.: 613,132

[22] Filed: Nov. 15, 1990

[30] Foreign Application Priority Data

Nov. 15, 1989 [JP] Japan ..... 1-295051

[51] Int. Cl.[6] ..... H01H 9/56

[52] U.S. Cl. ..... 307/141.4; 361/195

[58] Field of Search ..... 361/3, 5–7, 152, 361/153, 185–187, 195–202; 307/87, 592–598, 354, 130, 131, 141.4; 327/392–400, 78

[56] References Cited

U.S. PATENT DOCUMENTS 4,356,525 10/1982 Kornrumpf et al. ..... 361/4
4,745,515 5/1988 Fowler ..... 361/185
4,864,157 9/1989 Dickey ..... 307/135
4,922,363 5/1990 Long et al. ..... 361/3
5,008,516 4/1991 Holling ..... 219/519
5,055,962 10/1991 Peterson et al. ..... 361/187

*Primary Examiner*—Fritz Fleming
*Attorney, Agent, or Firm*—Antonelli, Terry, Stout & Kraus

[57] ABSTRACT

An apparatus for controlling a switching device provided for breaking or closing a power line connecting a power source to a load in an electric power system includes a switching timing control unit for controlling the timing to apply a breaking signal to said switching device in response to a breaking signal externally applied thereto so that the contacts of said switching device are opened during a period of time when the current flowing through said power line first reaches its peak value from a zero value and for controlling the timing of applying a closing signal to said switching device in response to a closing command preferably externally applied thereto so that the contacts of said switching device are closed when the voltage of said power source becomes a predetermined value depending upon whether said load is capacitive or inductive, and an operating unit for opening and closing said contacts of said switching device in response to said breaking and closing signals, respectively.

13 Claims, 5 Drawing Sheets

FIG. 5

| | | TRANSFORMER-REACTOR | | CAPACITOR-POWER SUPPLY LINE | |
|---|---|---|---|---|---|
| | | EFFECTIVELY GROUNDED SYSTEM | NON-EFFECTIVELY GROUNDED SYSTEM | EFFECTIVELY GROUNDED SYSTEM | NON-EFFECTIVELY GROUNDED SYSTEM |
| THREE PHASES OF INTEGRAL OPERATION | CLOSING | CLOSED AT A PEAK VALUE OF PHASE VOLTAGE<br>A - (60°- B) - (60°- C) | FIRST AND SECOND PHASES ARE CLOSED AT PEAK VALUE OF VOLTAGE (BETWEEN LINES). THIRD PHASE IS CLOSED AFTER 90°.<br>AB - (90°- C) | CLOSED AT ZERO VALUE OF PHASE VOLTAGE<br>A - (60°- B) - (60°- C) | FIRST AND SECOND PHASES ARE CLOSED AT ZERO VALUE OF VOLTAGE BETWEEN LINES. THIRD PHASE IS CLOSED AFTER 90°.<br>AB - (90°- C) |
| | BREAKING | OPENED BETWEEN ZERO AND PEAK OF CURRENT OF EACH PHASE<br>A - (60°- B) - (60°- C) | OPENED BETWEEN ZERO AND PEAK OF CURRENT OF EACH PHASE<br>A - (60°- B) - (60°- C) | OPENED BETWEEN ZERO AND PEAK OF CURRENT OF EACH PHASE<br>A - (60°- B) - (60°- C) | OPENED BETWEEN ZERO AND PEAK OF CURRENT OF EACH PHASE<br>A - (60°- B) - (60°- C) |
| | | AB - (60°- C)<br>BC - (60°- A)<br>CA - (60°- B) | AB - (60°- C) | AB - (60°- C) | AB - (60°- C) |
| | | | A - (120°- BC) | | |
| THREE PHASES OF INDEPENDENT OPERATION | CLOSING | CLOSED AT A PEAK VALUE OF PHASE VOLTAGE<br>A - (60°- B) - (60°- C) | FIRST AND SECOND PHASES ARE CLOSED AT A PEAK VALUE OF VOLTAGE (BETWEEN LINES). THIRD PHASE IS CLOSED AFTER 90°.<br>AB - (90°- C) | CLOSED AT ZERO VALUE OF PHASE VOLTAGE<br>A - (60°- B) - (60°- C) | FIRST AND SECOND PHASES ARE CLOSED AT ZERO VALUE OF VOLTAGE (BETWEEN LINES). THIRD PHASE IS CLOSED AFTER 90°.<br>AB - (90°- C) |
| | BREAKING | OPENED BETWEEN ZERO VALUE AND PEAK VALUE OF CURRENT OF EACH PHASE.<br>A - (60°- B) - (60°- C) | OPENED BETWEEN ZERO VALUE AND PEAK VALUE OF CURRENT OF EACH PHASE.<br>A - (60°- B) - (60°- C) | OPENED BETWEEN ZERO VALUE AND PEAK VALUE OF CURRENT OF EACH PHASE.<br>A - (60°- B) - (60°- C) | OPENED BETWEEN ZERO VALUE AND PEAK VALUE OF CURRENT OF EACH PHASE.<br>A - (60°- B) - (60°- C) |

APPARATUS FOR CONTROLLING OPENING AND CLOSING TIMINGS OF A SWITCHING DEVICE IN AN ELECTRIC POWER SYSTEM

BACKGROUND OF THE INVENTION

1. Field of the Invention

The present invention relates to a power switching control apparatus and in particular to a power switching control apparatus which prevents a phenomenon which gives serious effects to a power system and devices connected thereto by controlling the switching timing of a switching device in a power system.

2. Description of the Related Art

Approaches to prevent a transient phenomenon which is severe to systems and power devices by controlling the switching timing of a circuit breaker in a power system have heretofore been proposed.

A Conference Paper No. 13-12 of International Conference on Large High Voltage Electric Systems held in August–September 1988 entitled "Synchronous Energizing of Shunt Reactors and Shunt Capacitors"0 discloses that transient inrush currents which are generated upon energization of shunt reactors or shunt capacitors can be remarkably reduced by closing a circuit breaker for shunt reactors at a peak of a voltage of a power source and by closing the circuit breaker for shunt capacitors at a zero value of the power source voltage. Since the magnetic flux induced in a core of a reactor is proportional to the integral of a voltage, the magnetic flux after 0.5 cycle from the time when the reactor is energized at the peak value of the power source voltage is just zero so that the flux is not saturated. Therefore, inrush currents generated due to saturation of magnetic flux through the core do not occur in this case. Even if the closing of the circuit breaker is slightly shifted from the peak point of the voltage, the saturation of the magnetic flux will be slight and the inrush currents can be suppressed to a low value within a narrow range. In energization of the capacitors, the capacitors are energized at a zero voltage so that no high frequency inrush current will be generated. Even if the capacitors are energized at a time slightly different from the point of zero voltage, the voltage applied to the capacitors is low and the high frequency inrush currents can be suppressed to a low value within a narrow range. However, application of this approach to a practical system has technical problems as follows:

(1) A transient phenomenon occurs on breaking, as well as on closing. Generation of reignition or restrike will induce an abnormal voltage. A synchronous energizing technique alone can not eliminate a possibility of damage in insulation of apparatus.

(2) Circuit breakers are connected with various load devices. This synchronous energizing approach can be advantageously applied to a certain device while it may adversely affect on application to another device resulting in energization under worst conditions. It is very troublesome to mount different synchronous energizing devices to different load devices.

SUMMARY OF THE INVENTION

It is a first object of the present invention, in order to overcome the problem of the prior art, to provide a switching timing control apparatus for controlling the switching timing of a switching device for breaking or energizing a load current in a power system, which eliminates adverse effects due to breaking of the load current on the power system or devices connected therewith.

It is a second object of the present invention, in order to overcome the problems of the prior art, to provide a switching timing control apparatus for controlling the switching timing of a switching device for breaking or energizing a load current in a power system, which eliminates adverse effects due to energizing of the load current on the power system or devices connected therewith.

According to one aspect of the present invention, an apparatus for controlling a switching device provided for breaking or closing a power line connecting a power source to a load in an electric power system is arranged to comprise switching timing control means for controlling the timing of applying a breaking signal to said switching device so that the contacts of said switching device are closed while the current flowing through said power line changes from a zero value to its peak value and means for opening said contacts of said switching device in response to said breaking signal.

Since the contacts of the switching device are opened in such a phase that an arc will surely be extinct within a given finite period of time on breaking of a load current in an apparatus of the present invention with the above arrangement, an overvoltage across the contacts of the switching device due to reignition or restrike can be prevented from being generated irrespective of load conditions.

According to another aspect of the present invention, an apparatus for controlling a switching device provided for breaking or closing a power line connecting a power source to a load in an electric power system is arranged to comprise switching timing control means for controlling the timing of applying a closing signal to said switching device in response to a closing command externally applied thereto so that the contacts of said switching device are closed when the voltage of the power source becomes a predetermined value depending upon the conditions of said load and means for operating said switching device so that said contacts are closed in response to said closing signal.

Since the load is energized in a voltage phase preliminarily determined by a load condition whether the load connected with said switching device is capacitive or inductive on energization with a load current in an apparatus of the present invention with the above arrangement, energizing inrush currents or high frequency inrush currents can be minimized.

BRIEF DESCRIPTION OF THE DRAWINGS

FIG. 5 is a table showing switching timings of a switching device under various conditions.

DESCRIPTION OF THE PREFERRED EMBODIMENT

Figure 1:
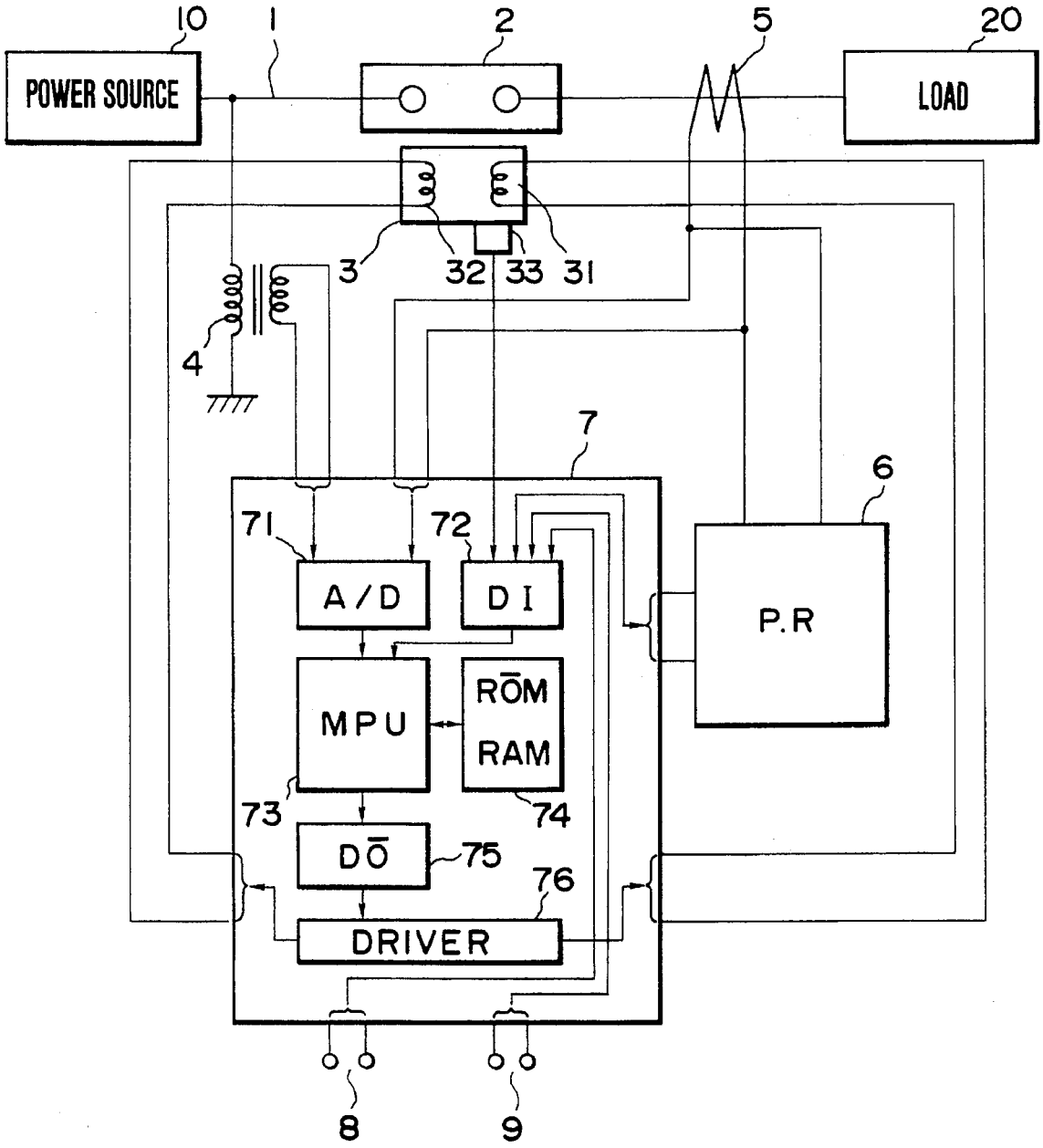
FIG. 1 is a block diagram showing an embodiment of a control apparatus of the present invention.

An embodiment of the present invention will be described with reference to FIG. 1. In FIG. 1, a circuit breaker 2 functioning as a switching device is connected with a main circuit 1 which connects a power source 10 of a power system with a load 20. The circuit breaker 2 is operated for breaking or closing by a breaking coil 31 or a closing coil 32, respectively provided in an operating unit 3. A potential transformer is provided for measuring the input voltage on the power source side of the circuit breaker. A current transformer 5 is provided for measuring the load current on the load side of the circuit breaker. An overcurrent relay 6 is provided at the output side of the current measuring transformer 5. A control system of the circuit breaker 2 is provided with a switching timing control unit 7. The switching timing control unit 7 comprises an A/D converter 71 for analog-to-digital converting the signals from the potential transformer 4 and the current transformer 5, a digital input unit 72 for inputting a closing command for the circuit breaker 2 from a terminal 8 or a breaking command from a terminal 9, a microprocessor 73, a memory device 74, a digital output unit 75 for outputting the signals from the microprocessor 73 and a driver unit 76 for outputting a breaking or closing command to an operating unit 3 of the circuit breaker 2 according to a digital output from the digital output unit 75.

Operation of the above mentioned switching timing control unit 7 will now be described with reference to FIGS. 2 through 4.

Figure 2:
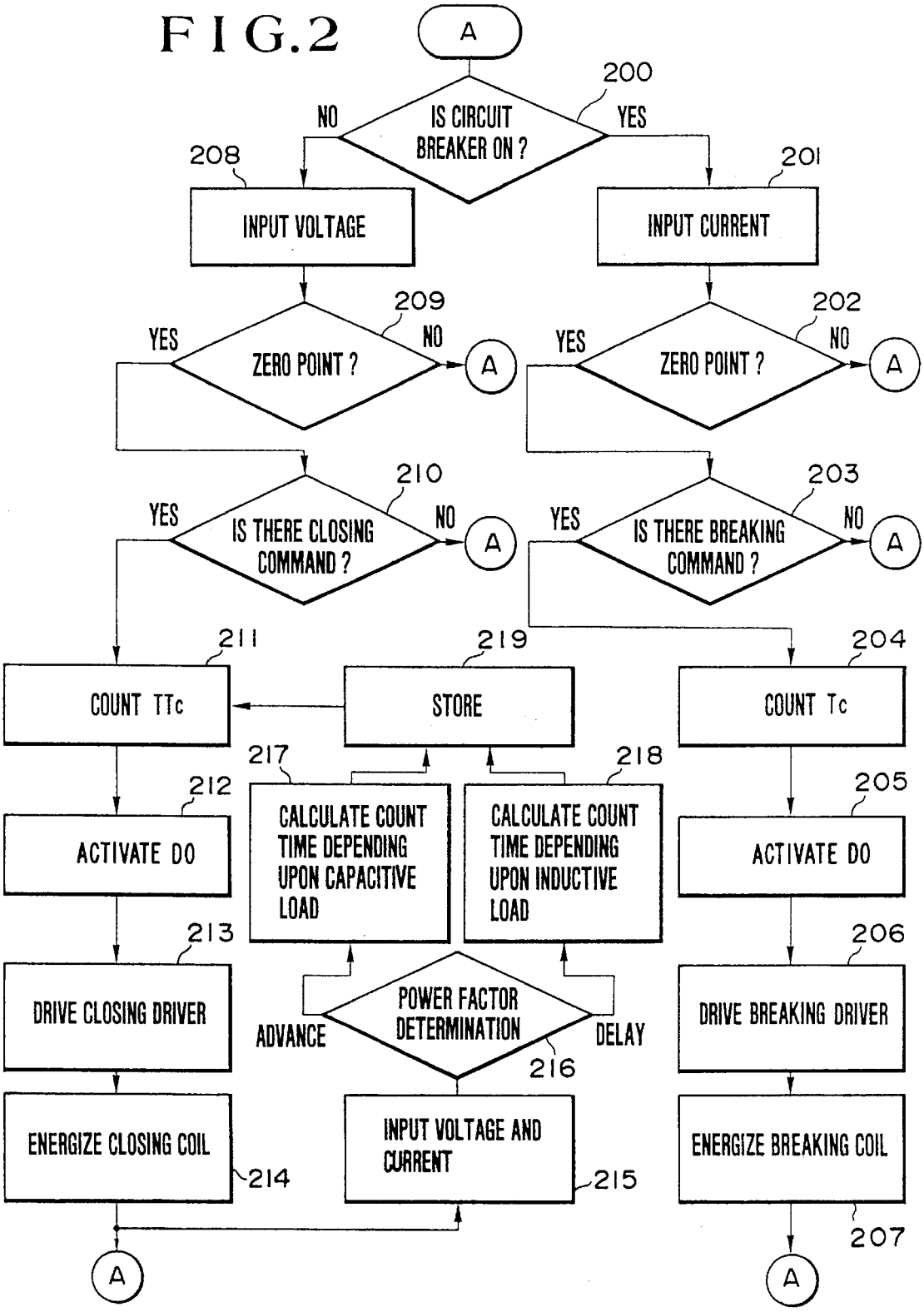
FIG. 2 is a flow chart showing the operation of the apparatus of FIG. 1.

Beginning at a point of switching timing control unit 7 first determines based on the signals from auxiliary contacts 33 whether the circuit breaker 2 is on or off (step 200 in FIG. 2). If the circuit breaker 2 is on or closed, the unit 7 determines from a signal inputted from the current transformer 4 (step 201 in FIG. 2) whether or not the current is at a zero value (step 202 in FIG. 2). If the current is not zero, the program returns to the starting point A. If the current is zero, the unit 7 determines whether or not a breaking command is inputted thereto from the terminal 9 (step 203 in FIG. 2). If the breaking command is not inputted, the program will return to the starting point A. If the breaking command is inputted, the microprocessor 73 begins to count clock pulses generated from a clock generator (not shown) incorporated therein. When the count reaches a preset value corresponding to a time interval Tc mentioned below (step 204 in FIG. 2), it activates the digital output unit 75 (step 205 in FIG. 2). This causes the digital output unit 75 to drive the driver unit 76 (step 206 in FIG. 2) and to energize the breaking coil 31 of the circuit breaker 2 (step 207 in FIG. 2). As a result of this, the circuit breaker 2 will begin its operation for opening the contacts, which requires generally a certain opening time Topen specific thereto. The program returns to the starting point while the circuit breaker begins to open its contacts. A time chart of this operation is shown in FIG. 3. The time Tc is determined so that a sum T of the time Tc counted at step 204 and the opening time Topen specific to the circuit breaker required for opening its contacts satisfies the following condition:

$$n/(2f)<T<(n+1/4)/(2f) \quad (1)$$

wherein f is a frequency of the system to which the circuit breaker 2 is applied and n is an integer. The time Tc as determined based on the formula (1) is stored in the memory device 74. Accordingly, the contacts of the circuit breaker 2 surely open at a time between a zero point of current and its peak point at ¼ cycle after the zero point.

Figure 3:
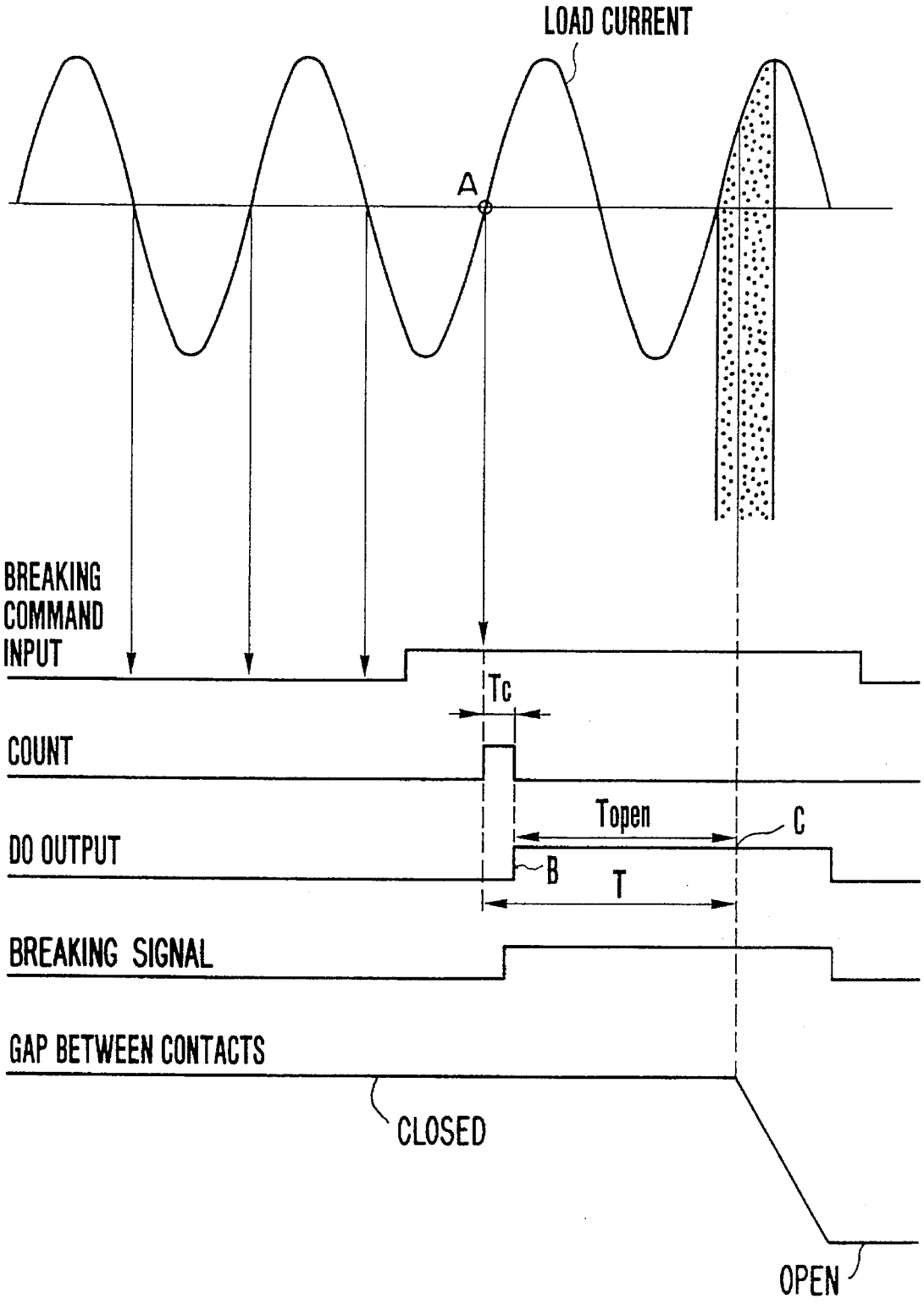
FIG. 3 is a diagram for explaining the opening timing of contacts of a switching device in the first embodiment of the present invention when a load current is broken.

FIG. 3 shows a case in which a value of Tc is preset corresponding to a value T in which n is selected as 2 (n=2) in formula 1. In this case, the microprocessor 73 commences counting of the clock pulses at point A. A breaking signal is generated from the digital output unit 75 at a point B when the count reaches a value corresponding to a time interval Tc. The circuit breaker commences separating its contacts at a point C after a lapse of Topen. This means that an arc time on breaking a load current by the circuit breaker 2 is surely 0.25 to 0.5 cycle. That is, a gap between the contacts of the circuit breaker 2 at a time of breaking current (extinction of the arc) is always a distance corresponding to an arc time of 0.25 cycle to 0.5 cycle.

In a prior art apparatus, the contacts of the circuit breaker separate in a zero cycle or a very short arc lasting period of time. Accordingly, the contacts may not be separated by a large enough gap length when the arc is extinct. Since the contacts are separated by a large enough distance at extinction of the arc in the present invention, the dielectric breakdown voltage between the contacts can be remarkably increased in comparison with the prior apparatus.

Figure 4:
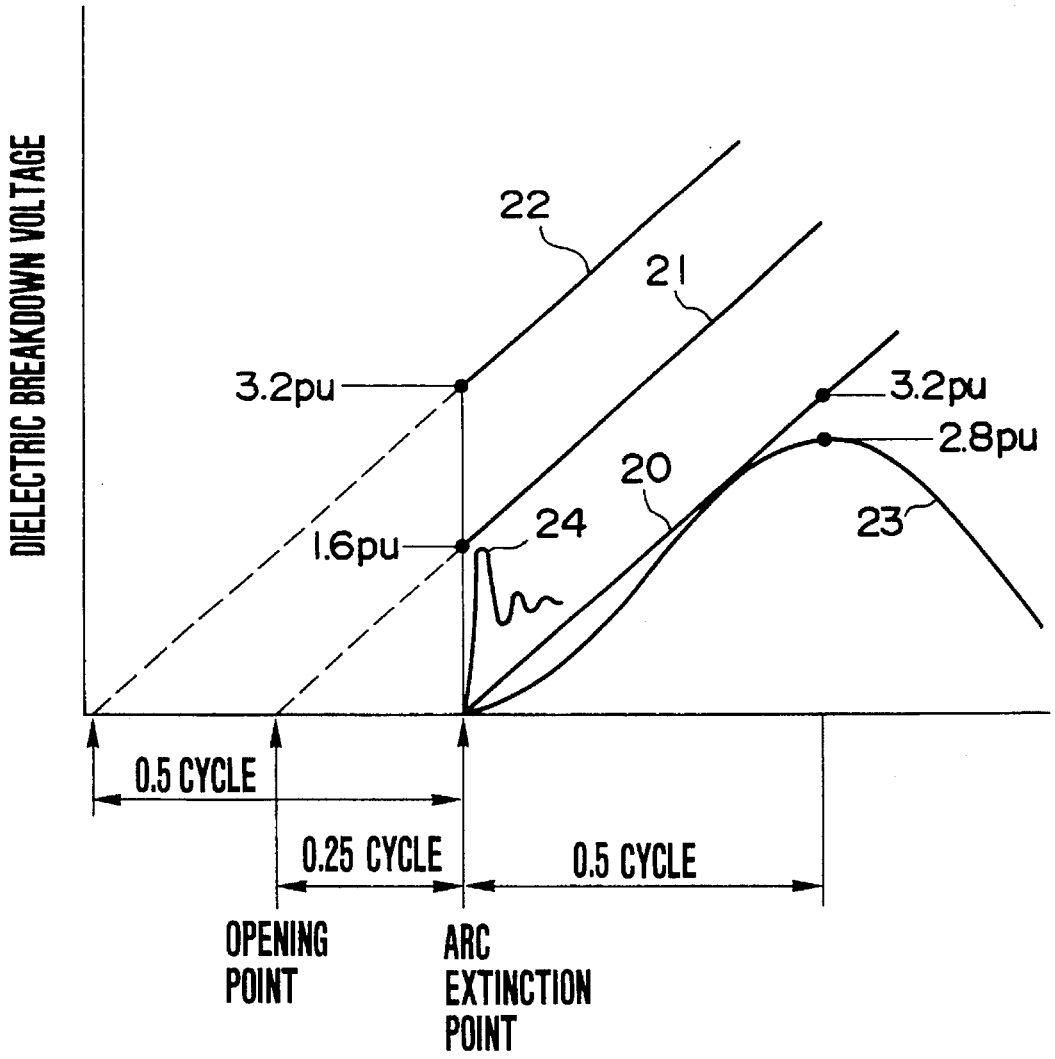
FIG. 4 is a diagram showing the relation between the voltage across the contacts of the switching device and the dielectric breakdown voltage on the breaking of the load current.

The relation is shown in FIG. 4. FIG. 4 shows the relation between the voltage across the contacts and the dielectric breakdown voltage on breaking. In the drawing, the abscissa denotes time and the ordinate denotes voltage. Reference numerals 20, 21 and 22 indicate the characteristic curves of the dielectric breakdown voltage between the contacts when the arc is extinct with the gap length between the contacts corresponding to arc time of zero, 0.25 and 0.5 cycle, respectively. A curve 23 denotes the voltage applied across the contacts of the circuit breaker when the load is capacitive such as a starting capacitor bank, a shunt capacitor, or a capacitance between cables and between ground and cables. A curve 24 denotes a voltage applied across the contacts immediately after breaking current when the load is inductive such as a shunt reactor, an unloaded transformer, a motor and the like. The dielectric breakdown voltage on breaking a capacitive load with the arc continuing for substantially zero cycle is required to resist against a wave $(1-\cos(\omega t))\ V_0$, where $V_0$ is 1.4 times as high as a phase voltage peak value if the system is an effectively grounded system since it should meet circuit breaker standards (for example, JEC-2300 and IEC-Pub 56, etc.). The dielectric breakdown voltage between the contacts of the circuit breaker is substantially proportional to the distance of the gap between the contacts. The dielectric breakdown voltage between the contacts after 0.5 cycle from the commencement of opening of the contacts is approximately equal to or more than 3.2 times as high as the peak value of the phase voltage. Accordingly, the breaking moment dielectric breakdown voltage after 0.25 cycle of arc time is not less that 1.6 times and the breaking moment dielectric breakdown voltage as high after 0.5 cycle of arc time is not less than 3.2 times as high. Therefore, the dielectric breaking voltage on breaking a capacitive load always has enough allowance relative to a voltage practically applied to the circuit breaker. Even if variations in the opening speed of the contacts and a slight decrease in dielectric breakdown voltage occur due to arc damage of the contacts and/or nozzle reignition or restrike will not occur, resulting in no accidents of dielectric breakdown. Therefore, reliability can be remarkably enhanced. For example, a non-effectively grounded system of 3.6 kV to 168 kV is required to resist against a wave of $(1-\cos(\omega t))\ V_0'$ where $V_0'$ is 1.7 times as high as the peak value of the phase voltage for cycle zero of the arc time of the circuit breaker. The dielectric breakdown voltages on current breaking (extinction of the arc) in case of 0.25 and 0.5 cycle of arc time are 1.84 and 3.88 times as high as the peak value of the phase voltage, respectively, so that the same advantageous effects are achieved. On breaking an inductive load, oscillation specific to the inductive load occurs so that a transient recovery voltage having a relatively high frequency which is approximately 1 kHz appears between the contacts of the circuit breaker. For example, the amplitude of the transient recovery voltage is about 1.5 times as high as the peak value of phase voltage. The probability that the arc time is 0 to 0.25 cycle is approximately 50% in case of prior art having no switching timing control unit. In such a case, the breaking moment dielectric breakdown voltage between the contacts is not higher than 1.6 times as the peak value of the phase voltage, resulting in that reignition almost surely occurs. If the contacts are opened for breaking the high frequency current generated on reignition, multiple reignitions in which reignition is repeated many times would be developed. In the multiple reignitions, energy is stored in an inductance in a load on each reignition so that the competition between the increase in dielectric strength between the contacts due to progress of opening or separation of the contacts and the increase in amplitude of transient recovery votlage may cause generation of an excessive surge voltage to breakdown the insulation of devices. Such a multiple reignition has been frequently found in gas filled circuit breakers or vacuum circuit breakers. In the present invention, the dielectric breakdown voltage between the contacts in the instant of breaking is higher than 1.6 times so that there is no fear of reignition. Therefore, no multiple reignition phenomenon is induced and insulation of devices is not broken. Therefore, a surge absorber which is used to suppress such an excessive surge voltage may be eliminated. In such a manner, a very highly reliable power switching apparatus which effectively suppresses the generation of reignition and restrike and will not cause damage to the dielectric strength of apparatuses can be provided in accordance with the present invention.

If an overcurrent is generated due to short-circuiting, the overcurrent relay 6 is energized to activate the switching timing control unit 7 for breaking of the circuit breaker 2 in the same procedure as mentioned above.

Now, contact timing control of the contacts of the circuit breaker on closing of the circuit breaker 2 will be described.

If it is detected that the circuit breaker 2 is at off (step 200 in FIG. 2), a voltage derived from the potential transformer 4 (step 208 in FIG. 2) is checked for determination of the zero value (step 209 in FIG. 2). If the inputted voltage is not zero, the program returns to the starting point A. If it is zero, determination whether or not a closing command is inputted to the terminal 9 (step 210 in FIG. 2) is performed. If the closing command is not inputted, the program returns to the starting point A. If the closing command exists, the microprocessor 73 commences to count clock pulses (step 211). When the count reaches a preset value corresponding to the count time TTc which will be described below, a digital output is generated from the digital output unit 75 (step 212 in FIG. 2) to drive the driver unit 76 (step 213 in FIG. 2) for energizing the closing operation coil 32 (step 214 in FIG. 2). After the closing time $T_{cl}$ specific to the circuit breaker 2 has then passed, the contacts of the circuit breaker 2 are closed. After a lapse of a sum time TT of the above mentioned count time TTc and the closing time $T_{cl}$ specific to the circuit breaker 2, the contacts are closed.

The count time TTc is preset to different values depending upon whether the load is capacitive or inductive. That is, the value of TTc is selected so that $TT=T_{cl}+TTc$ satisfies, when the load is capacitive, $$TT=n\times\tfrac{1}{2}f \quad (2)$$

and, when the load is inductive, $$TT=N\times\tfrac{1}{2}f+\tfrac{1}{4}f \quad (3)$$

By selecting TTc in such a manner, the circuit breaker can be synchronously closed. That is, it is possible, in the effectively grounded power system using phase-independent multi-phase circuit breaker, to suppress the high frequency inrush currents through capacitive loads by closing the contacts in each phase of the circuit breaker at zero point of the phase voltage and suppress the exciting inrush currents through inductive loads by closing the contacts in each phase at peak point of the phase voltage. The load which is connected with the circuit breaker may be capacitive or inductive. The count time TTc is different for capacitive or inductive load. It will be suffice to store different count times TTc depending upon the load of the circuit breaker 2 in the memory device 74 in the switching timing control unit 7. The load which is to be connected with the circuit breaker may be changed to a capacitive or inductive load depending on the power system. In this case, it will be possible to cope with either of the capacitive or inductive load by providing a presetting unit which changes the count time TTc. The presetting unit may be of manual type, or alternatively automatic type. For example, the automatic type presetting unit may be operated as follows: As shown in FIG. 2, a voltage waveform from the potential transformer 4 and a current waveform from the current transformer are inputted to the presetting unit (step 215 in FIG. 2), thereby to calculate a power factor of the circuit. The count time for capacitive load or the count time for inductive load are calculated (steps 217 and 218, respectively in FIG. 2). Then these count times are stored (step 219 in FIG. 2) and the count may be preset in the presetting unit based on the stored count times. Alternatively it is possible to preset the count by receiving a signal from a suitable controller for operating the system.

Although the above embodiment has been described with reference to a circuit breaker of three phases operative independently of each other, one switching timing control unit may be provided for each phase, or alternatively one switching timing control unit may be used commonly for controlling all three phases.

An embodiment in which the present invention is applied to a circuit breaker of three-phases integratedly operated will now be described. Firstly, the circuit breaker is formed in such a manner that the opening time of the contacts for each phase of the circuit breaker 2 is shifted so as to provide 60° electrical angle between opening times of the respective contacts of every adjacent two phases of the circuit breaker. Such a circuit breaker cna be obtained by changing the length of sliding contact between movable and stationary contacts of the circuit breaker or by modifying a link mechanism which forms an operation unit of the circuit breaker. The switching timing control unit which has been described with reference to FIG. 1 is applied to a circuit breaker unit which is connected to a phase which is firstly to be opened. By forming the circuit breaker in such a manner, it is possible to open the contacts of the circuit breaker between a current zero point and a peak point for each phase. It is possible to positively assure 0.25 cycle or arc time for all three phases by mechanically presetting the circuit breaker so that the contacts are opened in an electrical angle of 60° from the current zero point in case of non effectively grounded system. However, it suffices that a firstly breaking phase does not generate a reignition in a non-effectively grounded system, since if the second and third phases are broken in the non-effectively grounded system, a series breaking having two breaking points is established for breaking the second and third phases so that a voltage applied to one breaking point becomes a half. Assuming the order of phases in a system be A, B and C, the switching timing control unit may be applied to phase A and the contacts of circuit breakers connected with phases A and B may be opened at the same time and the contacts of a circuit breaker connected with phase C may be opened with a delay of 60°. In case of non-effectively grounded system, a switching timing control unit may be applied to a circuit breaker connected with phase A and the contacts of circuit breakers connected with phases B and C may be opened at the same time with a time interval of 120° from the opening of the contacts of the circuit breaker connected with phase A.

Operation of closing is similar to that of breaking. In case of a circuit breaker used for an effectively grounded system, closing times of the contacts for the respective phases of the circuit breaker are shifted to provide 60° in electrical angle between closings of every adjacent two phases. The switching timing control unit which has been described with reference to FIG. 1 is applied to a circuit breaker connected with a first phase to be firstly closed. By thus forming, it is possible to close contacts at a zero value of the power source voltage for capacitive loads and at a peak value for inductive loads. In a non-effectively grounded system, an unit which delays closing of the contacts of one phase by 90° in electrical angle from the voltage between the other two phases is provided so that the switching timing is controlled based on the phase voltage between given two phases, for example, phases A and B. If the contacts of the circuit breakers in phases A and B are closed at a zero value of the phase voltage between A and B phases in case of a capacitive load, the circuit breaker of phase C which is delayed by 90° will close its contacts at a zero value of the intermediate voltage between the phases A and B, resulting in no generation of high frequency inrush currents. In case of an inductive load, the contacts of the circuit breakers for two phases are closed at a peak value of the phase voltage and the contacts of the circuit breaker for the remaining phase are closed with a time delay of 90° therefrom. At this time, the voltage of the remaining phase assumes a peak value with respect to the intermediate of the phase voltage so that no energizing inrush current is generated. These closings can sufficiently suppress the energizing inrush currents and high frequency inrush currents even if the timing varies more or less due to variations of the closing speed of the contacts and a leading arc.

Operation of the above mentioned synchronous switching is summarized in a table shown in FIG. 5.

The above mentioned switching timing control unit 7 may be provided in a main body of the circuit breaker or alternatively its functions may be incorporated in the overcurrent relay 6. The switching timing control unit 7 may be made of a one chip LSI. It is not always necessary to use a microprocessor and other logic circuits may be used in lieu of the microprocessor.

Since the present invention sets the opening timing of the contacts of the circuit breaker during an interval between a zero point and a peak point of a breaking current where an absolute value of the current is increased as mentioned above, the arc period of time is always not less than 0.25 cycles so that a sufficient opening and separation length between the contacts may be assured for increasing the dielectric breakdown voltage at the current-breaking instant. As a result of this, reignition and restrike can be satisfactorily suppressed. This prevents an excessively high overcurrent from being generated. Therefore, a power switching apparatus having a high reliability which will not break down insulation of devices can be provided.

We claim:

1. An apparatus for controlling a switching device provided for breaking or closing a power line connecting a power source to a load in an electric power system, said apparatus comprising:

switching timing control means responsive to a breaking command externally applied thereto for applying a breaking signal to said switching device at a timing which is controlled so that contacts of said switching device will be opened during a ¼ cycle from a zero value to a peak value of a load current flowing through said power line; and operating means for operating said switching device in response to said breaking signal.

2. An apparatus according to claim 1, wherein said switching timing control means comprises:

means for detecting the zero value of said load current;

means for storing data representing a time interval from the detection of the zero value of said load current to generation of said breaking signal, said time interval being determined so that a sum of said time interval and an opening time specific to said switching device falls between two predetermined values related to a frequency of said electric power system; and means for generating said breaking signal after lapse of the time interval represented by the data stored in said storing means from the detection of the zero value of said load current.

3. An apparatus for controlling a switching device provided for breaking or closing a power line connecting a power source to a load in an electric power system, said apparatus comprising:

means for detecting whether said load is capacitive or inductive;

switching timing control means responsive to a closing command externally applied thereto for applying a closing signal to said switching device at a timing which is controlled so that contacts of said switching device will be closed when a voltage of said power source attains a value which varies depending on whether said load is capacitive or inductive; and operating means for operating said switching device in response to said closing signal.

4. An apparatus according to claim 3, wherein said switching timing control means comprises:

means for detecting a zero value of said power source voltage;

means for storing data representing a time interval from the detection of the zero value of said power source voltage to the generation of said closing signal, said time interval being determined so that a sum of said time interval and a closing time specific to said switching device is equal to a predetermined value which is related to a frequency of the electric power system and varies depending on whether said load is capacitive or inductive; and means for generating said closing signal after lapse of the time interval represented by the data stored in said storing means from the detection of the zero value of said power source voltage.

5. An apparatus according to claim 4, wherein said predetermined value is determined so that:

the contacts of said switching device will be closed when the power source voltage attains a zero value when said load is capacitive; and the contacts of said switching device will be closed when said power source voltage attains a peak value when said load is inductive.

6. An apparatus according to claim 5, wherein said detecting means detects whether the load is capacitive or inductive based on a load current flowing through said power line and said power source voltage when said switching device is closed.

7. An apparatus for controlling a switching device provided for breaking or closing a power line connecting a power source to a load in an electric power system, said apparatus comprising:

means for detecting whether said load is capacitive or inductive;

switching timing control means responsive to a breaking command externally applied thereto for applying a breaking signal to said switching device at a timing which is controlled so that contacts of said switching device will be opened during a ¼ cycle from a zero value to a peak value of a load current flowing through said power line and for applying a closing signal to said switching device at a timing which is controlled so that the contacts of said switching device will be closed when a voltage of said power source attains a value which varies depending on whether said load is capacitive or inductive; and operating means for operating said switching device in response to said breaking and closing signals.

8. An apparatus according to claim 7, wherein said switching timing control means comprises:

means for detecting the zero value of said load current;

means for detecting a zero value of said power source voltage;

means for storing first data representing a first time interval from the detection of the zero value of said load current to generation of said breaking signal, said first time interval being determined so that a sum of said first time interval and an opening time specific to said switching device falls between two predetermined values related to a frequency of said electric power system, and second data representing a second time interval from the detection of the zero value of said power source voltage to generation of said closing signal, said second time interval being determined so that a sum of said second time interval and a closing time specific to said switching device is equal to a predetermined value related to the frequency of said electric power system and determined so that the contacts of said switching device will be closed when said power source voltage attains the zero value when said load is capacitive; and operating signal generating means responsive to said breaking command for generating said breaking signal after lapse of the first time interval represented by said first data stored in said storing means from the detection of the zero value of said load current and responsive to said closing command for generating said closing signal after lapse of the second time interval represented by said second data stored in said storing means from the detection of the zero value of said power source voltage when said load is capacitive.

9. An apparatus according to claim 8, wherein said storing means also stores third data representing a third time interval from the detection of the zero value of said power source voltage to the generation of said closing signal, said third time interval being determined so that a sum of said third time interval and the closing time specific to said switching device is equal to a predetermined value related to the frequency of said electric power system and determined so that the contacts of said switching device will be closed when said power source voltage attains a peak value when said load is inductive; and wherein said operating signal generating means generates said closing signal after lapse of the third time interval represented by said third data from the detection of the zero value of said power source voltage when said load is inductive.

10. An apparatus according to claim 9, wherein said detecting means detects whether the load is capacitive or inductive based on the load current and the power source voltage when said switching device is closed.

11. An apparatus for controlling an integral three-phase switching device including three circuit breakers which are connected, respectively, in three phases of a power line connecting a power source to a load in a three-phase electric power system and are operated by a common operating unit, wherein said circuit breakers open successively at predetermined time intervals when operated by said common operating unit in response to a breaking command externally applied thereto, said apparatus comprising:

means for providing a breaking signal for opening said circuit breakers to said common operating unit in response to said breaking command; and switching timing control means for controlling the timing at which said breaking signal is applied to said common operating unit so that contacts of one of said circuit breakers which is to be opened first will be opened during a ¼ cycle from a zero value to a peak value of a load current flowing through one phase of the three phases in which said one circuit breaker is connected.

12. An apparatus for controlling an integral three-phase switching device including three circuit breakers which are connected, respectively, in three phases of a power line connecting a power source to a load in a three-phase electric power system and are operated by a common operating unit, wherein said circuit breakers close successively at predetermined time intervals when operated by said common operating unit in response to a closing command externally applied thereto, said apparatus comprising:

means for detecting whether said load is capacitive or inductive;

means for applying a closing signal for closing said circuit breakers to said common operating unit in response to said closing command; and switching timing control means for controlling the timing at which said closing signal is applied to said common operating unit so that contacts of one of said circuit breakers which is to be closed first will be closed when a voltage of one phase of the three phases in which said one circuit breaker is connected attains a value which varies depending on whether said load is capacitive or inductive.

13. An apparatus for controlling an integral three-phase switching device including three circuit breakers which are connected, respectively, in three phases of a power line connecting a power source to a load in a three-phase electric power system and are operated by a common operating unit, wherein two of said circuit breakers close substantially at the same time when operated by said common operating unit in response to a closing command externally applied thereto, and the remaining circuit breaker closes after a predetermined time delay from the closing of said two circuit breakers, said apparatus comprising:

means for detecting whether said load is capacitive or inductive;

means for applying a closing signal to said common operating unit for closing said switching device in response to said closing command; and switching timing control means for controlling the timing at which said closing signal is applied to said common operating unit so that said two circuit breakers will be closed in response to said closing command when a voltage between two phases of the three phases in which said two circuit breakers are connected attains a value which varies depending on whether said load is capacitive or inductive.

* * * * *